United States Patent [19]

Pohl et al.

[11] Patent Number: 4,662,184

[45] Date of Patent: May 5, 1987

[54] SINGLE-SENSOR HEAD PUMP DEFROST CONTROL SYSTEM

[75] Inventors: Walter J. Pohl; William J. McCarty, both of Louisville, Ky.; Frederick E. Hicks, Portsmouth, Va.

[73] Assignee: General Electric Company, Louisville, Ky.

[21] Appl. No.: 816,448

[22] Filed: Jan. 6, 1986

[51] Int. Cl.[4] ..... F25D 21/06

[52] U.S. Cl. ..... 62/156; 62/234

[58] Field of Search ..... 62/156, 155, 234, 140, 62/128

[56] References Cited

U.S. PATENT DOCUMENTS

| | | | |
|---|---|---|---|
| 2,104,219 | 1/1938 | Bloom | 62/156 X |
| 4,102,391 | 7/1978 | Noland et al. | 165/29 |
| 4,215,555 | 8/1980 | Pohl | 62/126 |
| 4,373,349 | 2/1983 | Mueller | 62/156 |
| 4,432,211 | 2/1984 | Oishi et al. | 62/156 X |

FOREIGN PATENT DOCUMENTS

| | | | |
|---|---|---|---|
| 24097 | 8/1935 | Australia | 62/140 |
| 0024344 | 2/1979 | Japan | 62/156 |

*Primary Examiner*—Harry Tanner

*Attorney, Agent, or Firm*—H. Neil Houser; Radford M. Reams

[57] ABSTRACT

Disclosed are apparatus and methods for controlling the defrosting of the outdoor heat exchange coil of a heat pump. In general, the disclosed apparatus and methods use the differencee between the outdoor heat exchanger and the outdoor ambient temperature to determine when to initiate a defrosting operation. Only a single sensor is employed, this single sensor being positioned at least proximate the outdoor heat exchanger such that the sensor responds to ambient temperature when the heat pump is first started and the heat exchanger is free of frost, and such that the sensnor becomes surrounded with frost as frost builds up on the heat exchanger during operation. At the beginning of a run the sensor is employed to read the ambient temperature, which is memorized. As frost builds, the sensor begins to reflect the temperature of the heat exchanger as the sensor becomes increasingly insulated by the frost from the surrounding air. During operation thereafter, the sensor is periodically read, the difference between the prevailing sensor temperature and the stored reference is determined and compared to an established difference reference, and a defrosting operation is initiated if the comparison difference exceeds the difference reference. The single sensor is also employed to determine when to terminate a defrosting operation, and also to determine whether to operate the outdoor fan as an aid to a defrosting operation.

20 Claims, 7 Drawing Figures

SINGLE-SENSOR HEAD PUMP DEFROST CONTROL SYSTEM

BACKGROUND OF THE INVENTION

The present invention relates to apparatus and methods for controlling the defrosting of the outdoor heat exchanger of heat pumps or similar closed temperature conditioning systems which bridge indoor and outdoor environments, wherein a compressor is employed to circulate a refrigerant fluid through the system.

It is well known that systems such as heat pumps or the like operate on a reverse cycle principle. In general, such a system includes indoor and outdoor heat exchange coils which are exposed to their respective ambient conditions. When the temperature of indoor air is to be raised (heating mode), the compressor pumps refrigerant fluid through the indoor heat exchange coil which becomes warm and, subsequently, by way of expansion means, through the outdoor heat exchange coil, which heat-exchanges with outdoor air. The outdoor coil functions as a refrigerant evaporator by absorbing heat from the outdoor air and thus becomes even colder than the outdoor air.

Since the outdoor heat exchange coil under these conditions operates at a temperature less than ambient outdoor air, ambient moisture condenses on the outdoor heat exchanger and, depending upon conditions, can freeze to cause a layer of frost or ice to form on the outdoor heat exchanger. This layer of frost or ice acts as an insulator between the outdoor ambient air and the outdoor heat exchanger, and impairs effective heat transfer to the outdoor heat exchanger. Under such conditions, system efficiency is greatly reduced.

Insofar as the need to defrost is concerned, it makes no difference whether the frozen condensate is termed "frost" or "ice". Accordingly, the two terms are employed interchangeably herein.

A variety of techniques are known, appropriate to various specific types of systems, for effecting a defrosting operation once excessive frosting is detected. Perhaps the simplest technique is to merely interrupt compressor operation, whereupon some heat from the indoor side inevitably migrates to the outdoor side, and may very well be sufficient to melt the frost. In other cases, heat is actively supplied, such as by employing electrical resistance heaters, operating the outdoor fan in the event outdoor ambiant temperature is above 32° F., and operating the system in the opposite (indoor cooling) mode whereby hot compressed refrigerant is pumped into the outdoor heat exchanger which, at that point, is functioning as a condensor.

While a variety of straightforward techniques are known for supplying heat to defrost the outdoor heat exchanger when necessary, what is not so straightforward is determining when to initiate a defrosting operation. In a relatively simple conventional system, a temperature sensor is placed at the base of the outdoor heat exchanger, and is monitored during operation. When the sensed temperature falls below a predetermined threshhold, for example 10° F., a defrosting operation is initiated. In a typical system thus controlled, periodic defrosting occurs at outdoor ambient temperatures from 45° F. and below.

While such a simple system is relatively straightforward and serves the desired function, it is not optimum for all conditions, Clearly, overall efficiency of operation requires that defrosting occur when necessary, but only when necessary. One difficulty with a simple system is that ambient temperature has a significant effect on the sensitivity of the sensor to frost. Moreover, ambient conditions, which vary widely, affect the amount and rate at which frost builds on the outdoor heat exchanger. For example, the humidity of ambient air determines in some measure the rate of frost build up. Further, precipitation such as snow or freezing rain will affect the amount of frost deposited on the outdoor coil.

An effective frost control system must be capable of operating under a variety of ambient outdoor conditions in order to defrost the outdoor coil as necessary so as to operate the heat pump system at high efficiency.

Accordingly, various more elaborate systems, typically involving a plurality of sensors, have been proposed. One such system is described in Noland et al U.S. Pat. No. 4,102,391. The Noland et al system employs a pair of thermostats having capillary tube sensing elements, each of which extend so as to be influenced by temperatures in two different parts of the system.

Another example, particularly relevant in the context of the present invention, is disclosed in Pohl U.S. Pat. No. 4,215,554. In the system of that patent, a plurality of temperature sensors are employed, a particular pair of which comprise one sensing element positioned proximate the outdoor heat exchanger coil, preferably in direct contact with the bare coil, or between the coil fins, and another temperature sensing element exposed to the ambient outdoor air conditions prevailing near the outdoor heat exchanger, but spaced sufficiently far from it so as not to be affected by frost build-up thereon. A defrost cycle for the outdoor heat exchanger is initiated as a function of the temperature differential between the temperature of the outdoor heat exchanger and that of the ambient outdoor air, the precise temperature differential at which defrosting is triggered varying as a function of outdoor ambient air temperature.

Another decision to be made is when to terminate a defrosting operation. In a typical simple system employing a sensor located at the base of the outdoor heat exchanger, a decision is made to stop defrosting when the sensor temperature reaches, for example, 36° F., which represents a significant rise in temperature above the 32° F. latent heat of ice point.

The multi-sensor systems are typically more effective in adapting themselves to different ambient conditions. However, such systems are relatively costly insofar as the temperature sensors are relatively costly, since they need to be well-insulated, moisture-proof, and reliable over extended periods of time under occasional severe ambient conditions. Moreover, in a microprocessor-based system, analog-to-digital conversion of readings from a plurality of separate temperature sensors leads to added system cost and complexity.

SUMMARY OF THE INVENTION

Accordingly, it is an object of the invention to provide low-cost yet effective apparatus and methods for controlling the defrosting of the outdoor heat exchanger in a heat pump system.

It is a related object of the invention to provide such apparatus and methods which require only a single temperature sensor.

Briefly, in accordance with the invention, it is recognized that the temperature differential between the outdoor heat exchanger and the ambient outdoor air can in effect be sensed employing a single sensor, in combination with the capabilities of an intelligent control system, such as a microprocessor-based system.

The present invention is related to that of the above identified Pohl U.S. Pat. No. 4,215,554 in that the difference between the temperature of the outdoor heat exchange coil and the ambient temperature is employed to determine when to initiate a defrosting operation. However, unlike the system of Pohl U.S. Pat. No. 4,215,554, only a single temperature sensor is required.

More particularly, the one temperature sensor is positioned at least proximate the outdoor heat exchanger such that the sensor can respond to ambient temperature when the heat pump is first started and the heat exchanger is free of frost, and such that the sensor becomes surrounded with frost as frost builds up on the heat exchanger during operation of the heat pump. Thus, at the beginning of a run when there is no frost, the outdoor ambient temperature is read and memorized.

Apparatus in accordance with the invention additionally includes control means such as, but not necessarily limited to, a microprocessor-based control system, connected to the sensor and to appropriate means provided for effecting a defrosting operation. The control means includes means for reading the sensor and storing the sensor reading as representative of ambient temperature when the heat pump is first started and the heat pump is free of frost, and for thereafter at least periodically reading the sensor to determine a prevailing sensor temperature, compairing the prevailing sensor temperature to the stored sensor temperature reading to determine a temperature difference, and initiating a defrosting operation in the event the temperature difference exceeds an established difference preference.

Preferably, the control system includes means for establishing the difference reference as a function of ambient temperature, and the difference reference is within the approximate range of from 15° to 25° F.

Another decision to be made is when to stop a defrosting operation, and the single sensor of the present invention is employed for this purpose as well. To implement this decision, the control means further includes means for terminating a defrosting operation when sensor temperature exceeds a first predetermined temperature which is in excess of 32° F., a typical example of the first predetermined temperature being 36° F. This is significantly above the 32° F. latent heat of ice point, and when the outdoor temperature reaches 32° F., it can safely be assumed that all frost and ice have melted.

To make the determination of when to terminate a defrosting operation more reliable, the temperature sensor is positioned below the heat exchanger such that water from melting ice and frost runs over the temperature sensor.

Preferably as an aid to the defrosting operation, the outdoor fan is operated as conditions warrant. In general, during a defrosting operation, the outdoor fan should run until the temperature of the heat exchanger has leveled off at the outdoor ambient temperature level, thus helping to minimize warm-up time of the ice. After this, however, if the outdoor temperature is appreciably below freezing (as a matter of convenience defined as any temperature below 31° F.), the outdoor fan should not run, because this would make it more difficult for defrost heat, from whatever source, to melt the ice. Thus, another decision to be made by the control system is whether to run the outdoor fan.

In one approach of the invention, in the event ambient temperature is below a second predetermined temperature, for example 31° F., operation of the fan as an aid to defrosting is limited to a predetermined time duration, for example, five minutes. If ambient temperature is above 31° F., then the outdoor fan is allowed to run continuously, on the presumption that it will continue to aid the defrosting operation.

In a more sophisticated approach, which provides similar results, the rate of rise of sensor temperature is monitored by the control system, and the control system allows the outdoor fan to operate as an aid to defrosting so long as sensor temperature is rising, but stops operation of the outdoor fan in the event sensor temperature levels off at a temperature below 32° F.

A method in accordance with the invention for controlling defrosting in a heat pump having an outdoor heat exchanger susceptible to frosting, and a fan for circulating outdoor ambient air past the outdoor heat exchanger includes the steps of providing a temperature sensor positioned at least proximate the heat exchanger such that the sensor can respond to ambient temperature when the heat pump is first started and the heat exchanger is free of frost, and such that the sensor becomes surrounded with frost as frost builds up on the heat exchanger during operation of the heat pump. Preferably, the temperature sensor is positioned below the heat exchanger such that water from the melting frost runs over the temperature sensor.

The method further includes the step of determining ambient temperature when the heat pump is first started and the the heat exchanger is free of frost by reading the sensor and storing the sensor reading.

Finally, the method of the invention includes a step of thereafter at least periodically reading the sensor to determine a prevailing sensor temperature, comparing the prevailing sensor temperature to determine a temperature difference, and initiating a defrosting operation in the event the temperature difference exceeds an established difference reference. Preferably, the method also includes a step of establishing the difference reference as a function of ambient temperature.

The method of the invention also includes terminating a defrosting operation when sensor temperature exceeds a first predetermined temperature which is in excess of 32° F.

The method of the invention preferably includes operating the outdoor fan as an aid to defrosting, but limiting operation of the fan as an aid to defrosting to a predetermined time duration in the event ambient temperature is below a second predetermined temperature, as sensed by the single sensor.

Alternatively, in cases where the fan is operated as an aid to defrosting, the method includes the steps of determining the rate at which sensor temperature rises during a defrosting operation, and allowing the outdoor fan to operate as an aid to defrosting so long as sensor temperature is rising, and stopping operation of the outdoor fan in the event sensor temperature levels off at a temperature below 32° F.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description, taken in conjunction with the drawings, in which:

DETAILED DESCRIPTION

Figure 1:
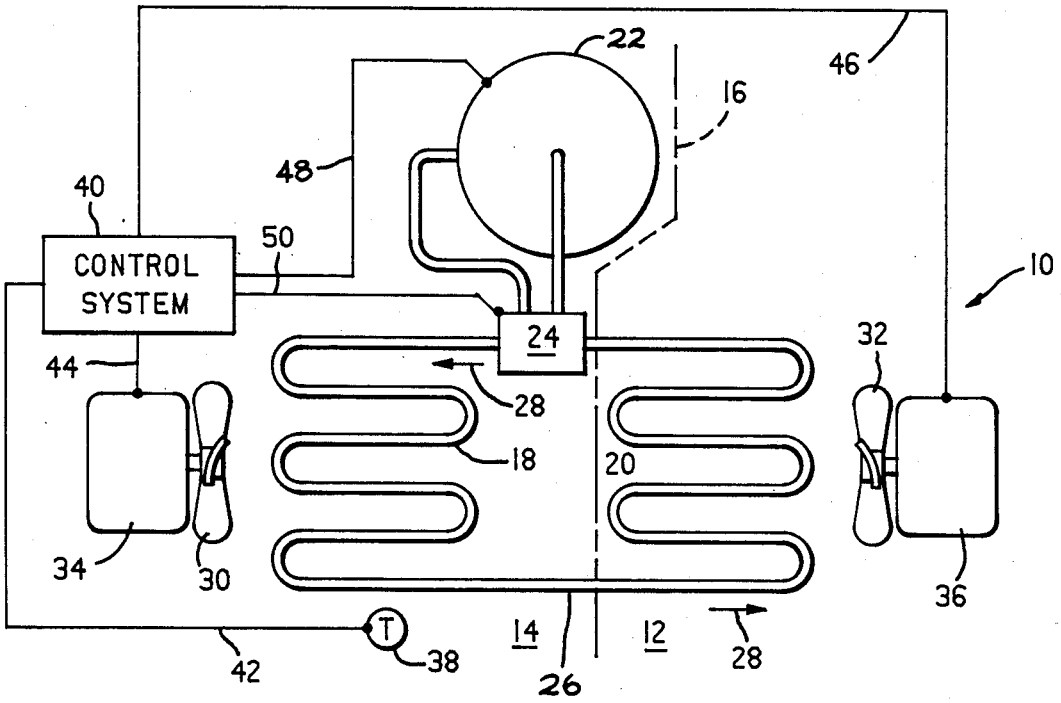
FIG. 1 is a diagrammatic view of a closed circuit refrigeration system typical of a reverse-cycle heat pump having an outdoor heat exchanger functioning as an evaporator during indoor heating operation.

With reference now to the drawings, FIG. 1 illustrates a representative temperature conditioning system 10 of the type in which the present invention may be employed. The system 10 comprises a reversible cycle, closed-circuit refrigeration system, commonly known as a heat pump. The system is divided into an indoor side 12 and an outdoor side 14 by a partition 16. FIG. 1 is representative of a variety of actual physical arrangements.

The system 10 includes an outdoor coil 18 which serves as a heat exchanger, an indoor coil 20 which serves as a heat exchanger, a refrigerant compressor 22 for circulating refrigerant through the system, and a reversing valve 24 which determines the direction of refrigerant flow. Although not illustrated, it will be appreciated that the system 10 also requires a suitable flow restricting or expansion device somewhere in a line 26 between the outdoor and indoor heat exchanger coils 18 and 20.

During heat pump operation for indoor heating, the mode with which the present invention is concerned, the reversing valve 24 is set such that refrigerant flows in the direction indicated by the arrows 28. Thus, high-pressure compressed gaseous refrigerant flows from the compressor 22 through the reversing valve 24 into the indoor heat exchanger coil 20, which functions as a condensor and gives off heat to the indoor side. Refrigerant flows from the indoor heat exchanger coil 20 through the line 26 including the flow restricting or expansion device (not shown), emerging as liquid refrigerant to flow into the outdoor heat exchanger coil 18, which functions as an evaporator, becomes cold and removes heat from the outdoor ambient.

Air circulation over the outdoor and indoor heat exchanger coils 18 and 20 is provided by a pair of fan blades 30 and 32 driven by respective motors 34 and 36. While separate fan motors 34 and 36 are shown in FIG. 1, in some physical arrangements, such as self-contained heat pump systems which somewhat resemble room air conditioners, a single fan motor may be provided to drive both fans.

In accordance with the invention, a single temperature sensor 38 is provided comprising, for example, a thermistor. The positioning of the thermistor 38 is an important aspect of the invention. What is important is that the temperature sensor 38 be placed so as to be able to measure ambient air temperatures at times when the outdoor heat exchanger coil 18 is free of frost and the system is first started to commence a run, and so as to be surrounded by ice or frost as ice or frost builds up around the outdoor heat exchanger coil 18. Under frosted conditions, the temperature sensor 38 is effectively insulated from the outdoor ambient temperature, and its temperature closely approximates that of the outdoor heat exchanger coil.

Preferably, in order to most accurately sense outdoor ambient temperature, the temperature sensor 38 is positioned close to the outdoor heat exchanger coil 18, but is not actually touching. It is possible, however, for the temperature sensor 38 to be touching the outdoor heat exchanger coil, but in this case an accurate reading of outdoor ambient temperature at the beginning of a run requires that the system be off for a sufficient amount of time to allow the temperature of the outdoor heat exchanger coil 18 to equalize with that of the surrounding ambient, a condition difficult to achieve in practice.

To enhance the accuracy of the decision whether to terminate a defrosting operation, the temperature sensor 38 is positioned so that defrost water from melting ice and frost flows or runs over the temperature sensor 38, which tends to keep the sensor at approximately 32° F. so long as defrost water continues to flow.

The precise form of outdoor heat exchanger coil 18 is not critical insofar as the present invention is concerned, and the invention is thus applicable to any type of coil. By way of non-limiting example, the invention is applicable to plate fin, spine fin, and pin fin heat exchangers.

The remaining element depicted in FIG. 1 is a control system 40 which serves a number of functions, including that of defrost control. An electrical connection 42 thus enables the control system 40 to monitor the temperature of the sensor 38. For causing controlled actions to occur, the control system 40 has representative output lines 44 and 46 for energizing the motors 34 and 36, a line 48 for energizing the refrigerant compressor 22, and a line 50 for controlling operation of the reversing valve 24.

In addition to the frost control aspect to which the present invention is directed, it will be appreciated that the control system 40 also typically effects a variety of other control functions, such as determining the mode of operation (whether heating or cooling), as well as thermostatic control of indoor temperature by cycling the refrigerant compressor 22 on and off as required. For this purpose, it will further be appreciated that the control system 40 also includes at least one room temperature sensing element (not shown), and a means for either temperature set point adjustment, which together comprise a thermostat.

Figure 2:
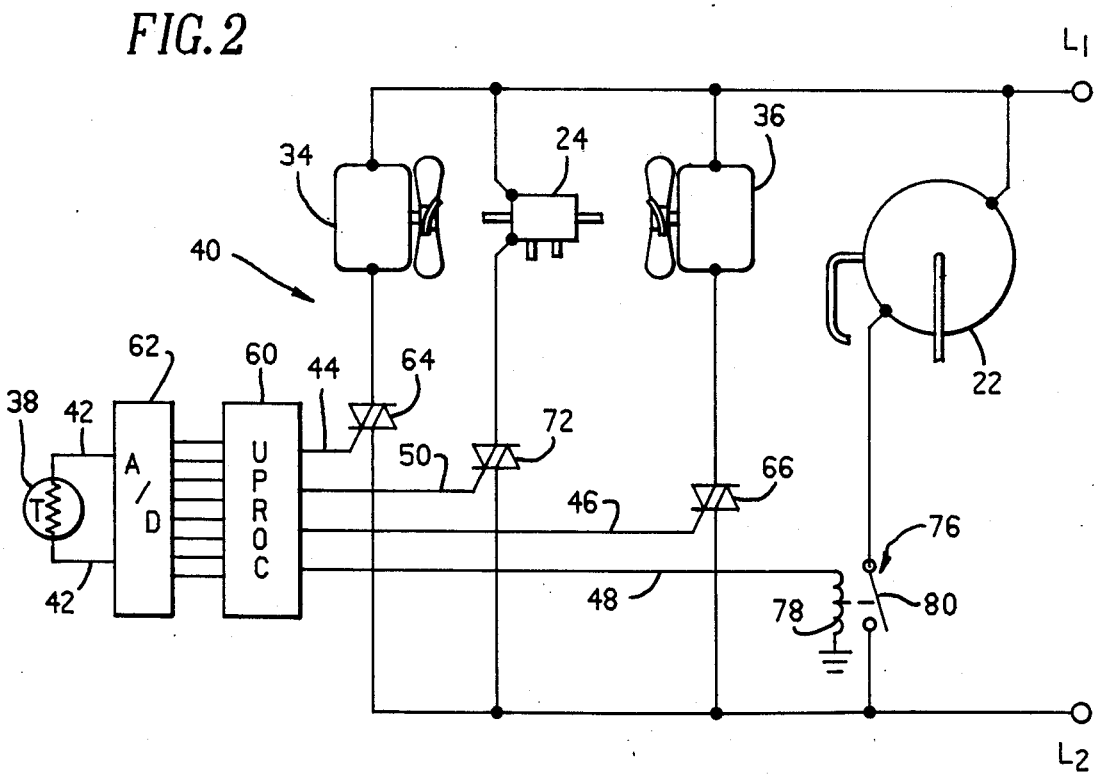
FIG. 2 is an electrical schematic circuit diagram depicting one form of control system applied to the refrigeration system of FIG. 1.

FIG. 2 depicts in greater detail a suitable control system, generally designated 40, applied to the heat pump system 10 of FIG. 1. The FIG. 2 control system is microprocessor-based, and thus includes a suitable microprocessor or microcontroller 60 operating under stored program control manner well known to those skilled in the art. While a variety of microprocessor systems may be employed, one which is suitable is a Motorola Semiconductor type No. M6805 single-chip N-channel microcontroller which includes, within a single integrated circuit device, program ROM, RAM, a CPU and a variety of I/O line drivers.

For input sensing, particularly from the temperature sensor 38, connected to the microcontroller 60 is an analog-to-digital (A/D) convertor 62, an input of which is in turn connected to the thermistor temperature sensor 38, physically positioned as described above with reference to FIG. 1. It will be appreciated that the particular connection 42 to the thermistor 38 depicted in FIG. 2 is representative only, as a conventional voltage or current source for converting thermistor 38 resistance to a voltage suitable for application to the A/D convertor 62 is omitted.

The microcontroller 60 is able to control the operation of the fan motors 34 and 36, the compressor 22, and the reversing valve 24 through suitable controlled switching elements connected in series with the respective controlled devices between AC power lines $L_1$ and $L_2$. For the relatively lower current fan motors 34 and 36, triacs 64 and 66 are employed, driven by respective output lines 44 and 46 from the microcontroller 60. Similarly, the reversing valve 24 is controlled through a triac 72 based on signals from the microcontroller output line 50. Finally, for controlling the relatively higher current compressor 22, a relay 76 is employed having a coil 78 and contacts 80, controlled by output line 48.

Figure 3:
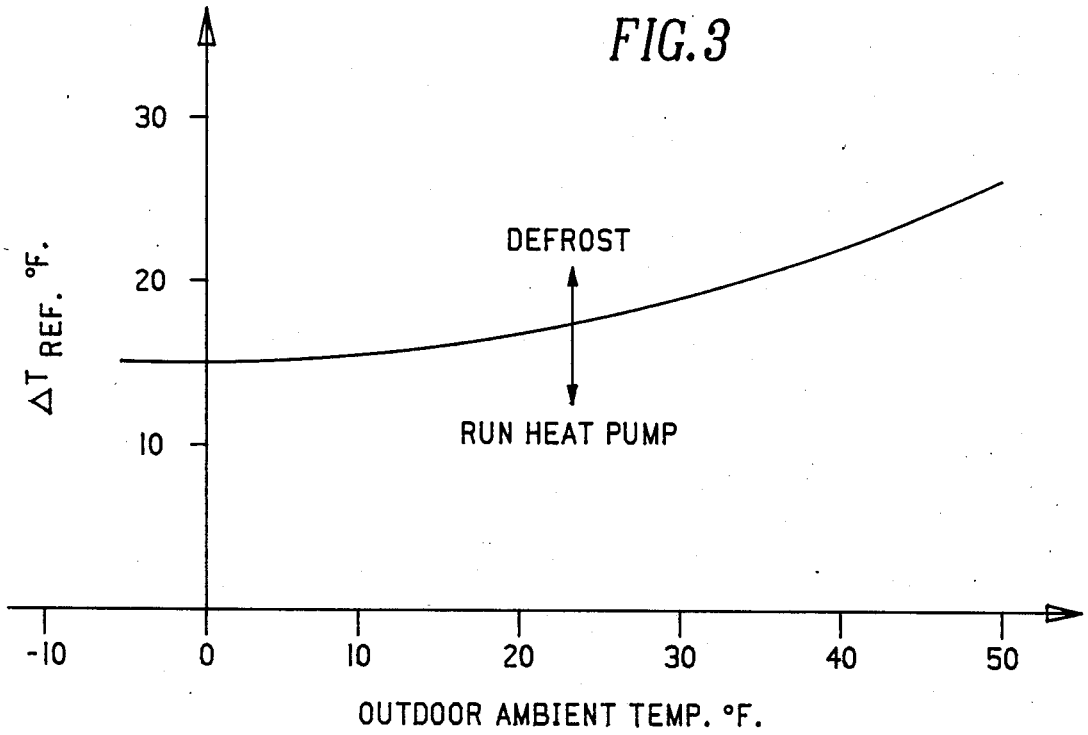
FIG. 3 is a plot relating to a criterion for the defrost start decision, specifically, a plot of the difference reference as a function of outdoor ambient temperature.

As discussed above, the general technique for determining when to initiate a defrosting operation is to monitor the temperature difference between the outdoor heat exchanger coil 18 and the ambient temperature, and to initiate a defrosting operation when this temperature difference exceeds an established difference reference, as is done in the system of the above-referenced Pohl U.S. Pat. No. 4,215,554. For optimum results, the difference reference is established as a function of outdoor ambient temperature, a typical function being that which is depicted in FIG. 3. In particular, FIG. 3 plots the established difference reference $\Delta T_{REF}$ as a function of outdoor ambient temperature. From FIG. 3, it will be noted that the difference reference $\Delta T_{REF}$ is established at approximately 15° at 0° F. outdoor ambient, and increases with increasing ambient outdoor temperature. Above 45° F. outdoor ambient defrosting is not needed.

As noted above, the invention also relates to techniques for determining when to terminate a defrosting operation, and for determining whether to operate the outdoor fan 30 as an aid to defrosting operation. The plots of FIG. 4 relate to the techniques employed for making these determinations.

Figure 4:
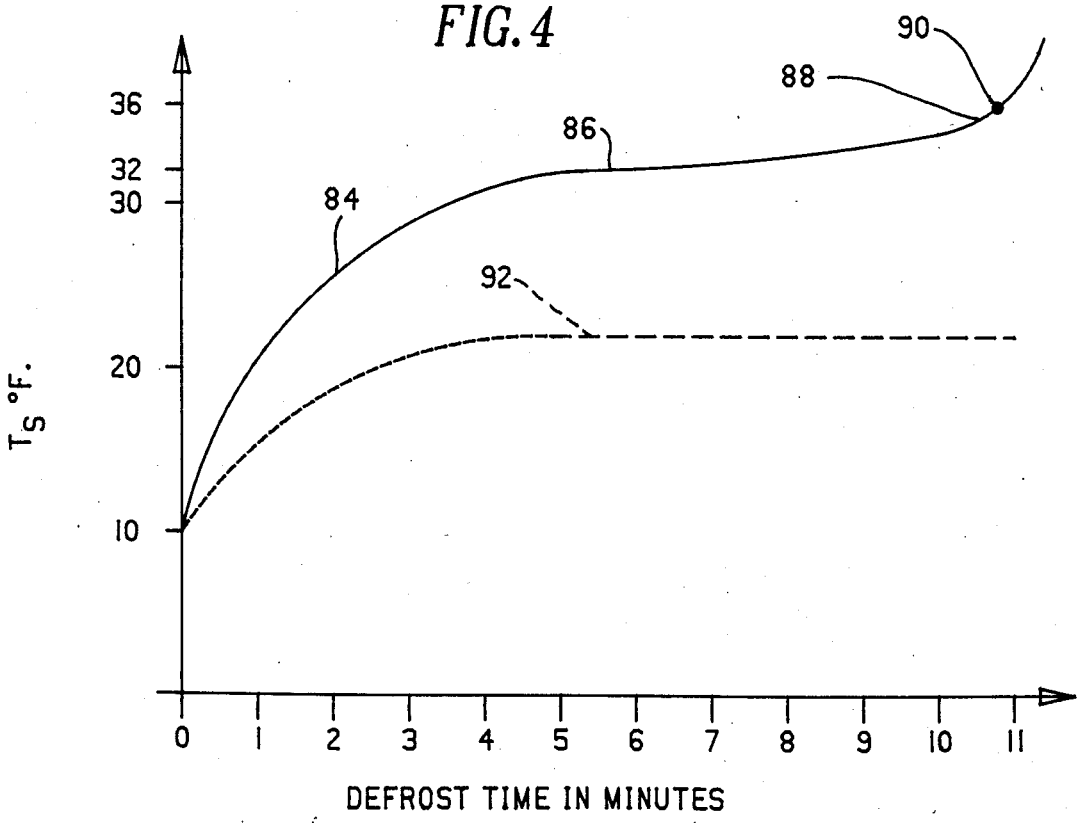
FIG. 4 is a plot depicting sensor temperature as a function of time during a typical defrosting operation.

More particularly, FIG. 4 plots sensor temperature in ° F. as a function of time in minutes for a typical defrosting operation. Considering the first portion 84 of the plot line, starting at 10° F. sensor temperature rises for a period of about five minutes up to 32° F., during which time the temperature of the ice is increasing. At this point, the ice begins to melt, and the latent heat of the ice keeps the sensor temperature at approximately 32° F., as is represented by the intermediate portion 86 of the line.

After all the ice has melted, sensor temperature again begins to rise, as indicated by the last portion 88 of the line, until a termination point 90, set for example at 36° F. is reached.

As mentioned above, the outdoor fan 30 may be employed as an aid to defrosting. However, if outdoor ambient temperature is below approximately 31° F., the outdoor fan 30 should be run for such purpose only for a limited period of time. The dash plot line 92 in FIG. 4 depicts the situation that would occur in the event ambient temperature is 22° F., for example, and the outdoor fan 30 is allowed to run continously. As will be seen, for approximately the first five minutes the temperature rises, aided somewhat by ambient air being circulated past the outdoor heat exchanger. However, after that point, the circulating ambient air tends to prevent the temperature from rising further, and can even prevent the frosting operation entirely.

Figure 5:
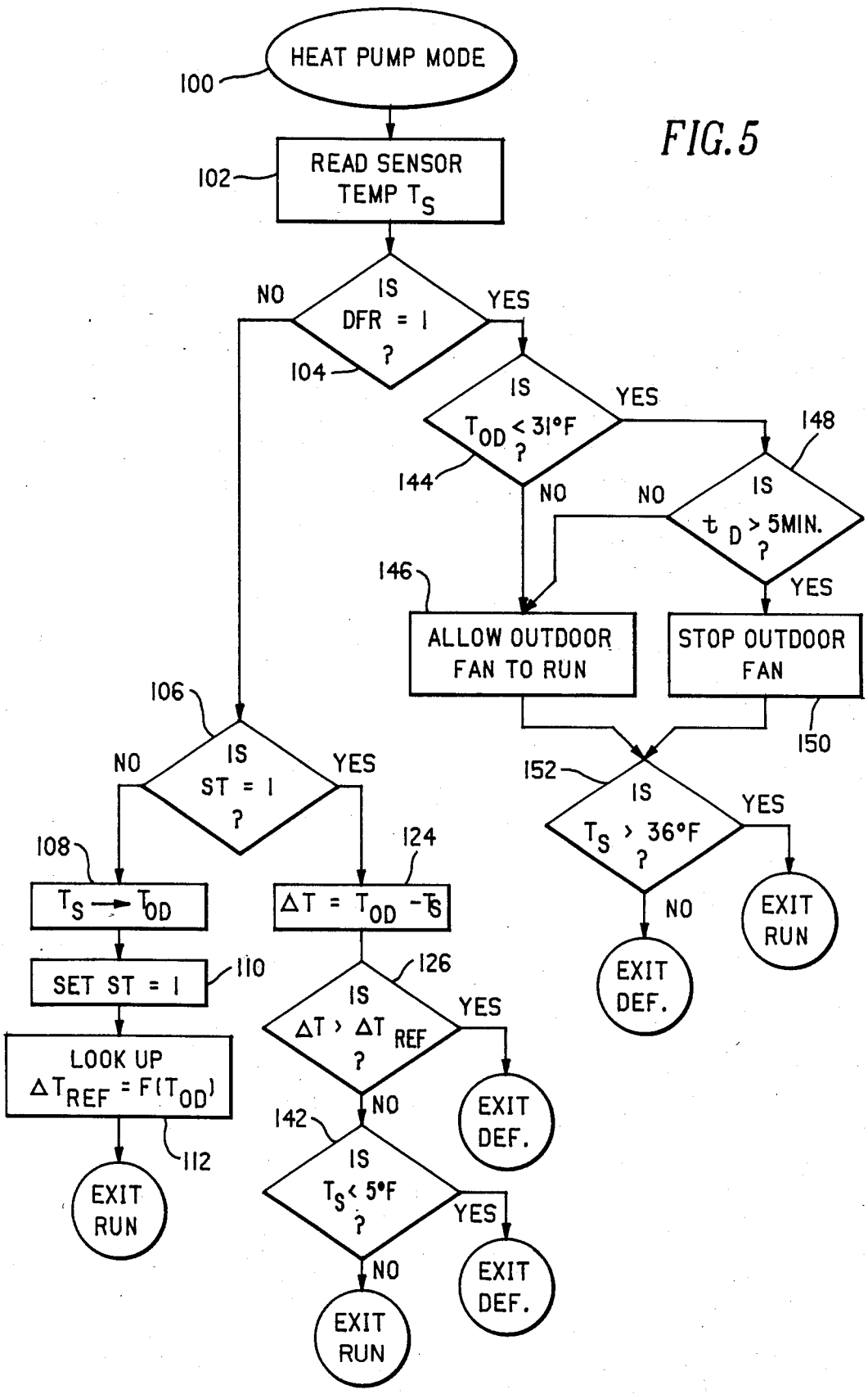
FIGS. 5, 6 and 7 comprises an exemplary program flow chart of a suitable algorithm for use in the practice of the invention.
Figure 6:
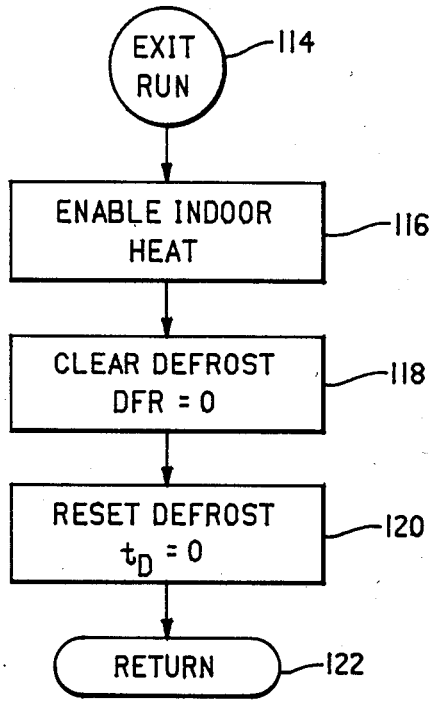
Figure 7:
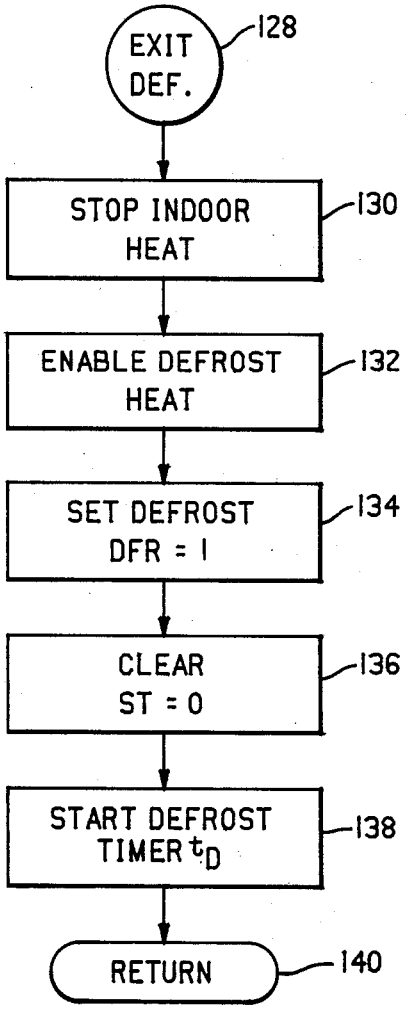

Referring now to FIGS. 5, 6, and 7 depicted is a typical program flowchart implemented in the microcontroller 60. It may be noted that one of the operations called for by the flowchart of FIG. 5 is that of reading the temperature sensor 38 to obtain a value $T_S$. It will be appreciated that this operation implies sampling, via the FIG. 2 A/D converter 62, a representation of the temperature sensed by the sensor 38.

It will further be appreciated that the routines of FIGS. 5, 6 and 7 are merely one part of an overall control program which continuously cycles through each of a number of routines, including those of FIGS. 5–7, in order to perform a number of other control operations required for the heat pump system 10, including those of thermostatic room temperature control, with which the present invention is not particularly concerned. The overall cycle may occur many times per second such that, in view of the relative slowness of the control events involved in a refrigeration system, from the point of view of each routine, each routine is essentially continuously executed from its entry point. Thus, while awaiting for a particular time interval to elapse, or for a particular condition to occur, for example, a particular routine is exited if that interval has not yet elapsed or the condition has not yet occurred. However, the routine is reentered perhaps only a fraction of a second later. The effect from the point of view of that particular routine is equivalent to a wait loop involving that routine alone.

Before considering the steps of the flowchart in detail, several flags, variables and a timer are defined in the following table.

| FLOWCHART FLAGS, VARIABLES AND TIMER | |
|---|---|
| | Flags |
| ST | Stored flag. ST = 1 if start temperature has been memorized as representative of the outdoor ambient temperature; otherwise ST = 0. |
| DFR | Defrost mode. DFR = 1 if in the defrost mode. DFR = 0 if in heat pump operation mode. |
| | Variables |
| TS | Sensor temperature reading |
| $T_{OD}$ | Outdoor ambient temperature |
| $\Delta T$ | Difference temperature $T_{OD} - T_S$ |
| $\Delta T_{REF}$ | Difference reference temperature |
| | Timer |
| $t_D$ | Accumulated defrost mode time in minutes. Timer maintained by either software or hardware. |

Referring to FIG. 5 in detail, a "HEAT PUMP MODE" routine begins at 100 and is entered over and over on a continous basis whenever the system is operating in a heat pump mode and the indoor thermostat (not shown) is requiring heat.

As an initial step, in box 102 the temperature sensed by the thermistor 38 is read, and stored as variable $T_S$.

At this point, decision box 104 is entered where the flag DFR is examined to determine whether the system is already in the defrost mode. If the answer is "no", the left branch is taken, which generally decides whether to initiate defrost at this time. If the answer is "yes", then the right branch is taken, which generally decides whether to terminate defrost at this time.

Considering the "no" branch first, the next step is decision box 106 where the flag ST is examined to determine whether the starting temperature of the sensor has been memorized as representing the ambient temperature. If the answer is "no", i.e. if ST=0, then box 108 is entered where the most recent sensor temperature reading $T_S$ is stored as the outdoor ambient $T_{OD}$.

In box 110, the flag ST is set to 1. Finally, in box 112, from a look-up table corresponding to the plot of FIG. 3 the appropriate difference reference temperature $\Delta T_{REF}$ is determined based on $T_{OD}$, and stored. At this point, the FIG. 6 "EXIT RUN" routine is entered.

Referring briefly to the FIG. 6 "EXIT RUN" routine, entered at 114, in box 116 heat pump operation (e.g. indoor heating) is enabled, if it is not already.

Then, in box 118 the defrost mode flag DFR is cleared to 0. In box 120, the defrost timer $t_D$ is then reset to zero if it not zero already. Finally, at box 122, the routine is exited entirely so another part of the control program (not shown) can be executed, before execution returns to the FIG. 5 "HEAT PUMP MODE" routine.

Returning to FIG. 5, if the answer in decision box 106 is "yes", then box 124 is entered wherein the current temperature difference $\Delta T$ is determined in a comparison operation which subtracts $T_S$ from $T_{OD}$.

Decision box 126 is entered, which is the first of two decision boxes where the determination is actually made as to whether to initiate a defrosting operation, box 126 being the primary decision point. In particular, in box 126, it is determined whether $\Delta T$ is greater than $\Delta T_{REF}$. If the answer is "yes", then it is time to initiate a defrosting operation, and the FIG. 7, "EXIT DEFROST" routine is entered.

Briefly considering the FIG. 7 "EXIT DEFROST" routine, which is entered at 128, the first step, in box 130 is to stop the indoor heating operation, if not already stopped.

Next, in box 132, defrost heat is enabled, if applicable in the particular refrigeration system. As noted above, in the "Background" section, a variety of methods are known in the art for providing defrost heat, and any of these may be employed.

Next, in box 134, the defrost flag DFR is set to 1, and in box 136, the stored flag ST is cleared to 0.

Finally, in box 138, the defrost timer $t_D$ is started running, if not running already, and, in box 140, a return is made to the remainder of the overall control program (not shown), and the FIG. 5 routine is subsequently reentered.

Returning to the FIG. 5 decision box 126, if the answer is "no", meaning that the primary defrost criterian has not been met, as a precaution decision box 142 is entered where it is determined whether sensor temperature $T_s$ is less than 5° F. The decision of box 142 provides added assurance that a defrosting operation will eventually be initiated, and it is particularly important under conditions where there is a significant change in outdoor ambient temperature while the heat pump is running. If a significant ambient temperature change occurs, the values for $T_{OD}$ and $\Delta T_{REF}$ determined at the beginning of the run may no longer be appropriate. If the answer in decision box 142 is "yes", then an exit is made to the FIG. 7 "exit defrost" routine, as described just above with reference to box 126. If the answer in decision box 142 is "no", then the FIG. 6 "exit run" is entered.

Returning to the first decision box 104 where it is decided whether the system is in the defrost mode, if the answer there is "yes", then a flowchart portion is entered wherein it is determined whether to terminate defrost and, additionally, whether to run the outdoor fan 30 as an aid to defrosting operation.

Decision box 144 relates to the function of controlling operation of the outdoor fan 30, and asks whether the outdoor ambient temperature is less than 31° F. If the answer is "no", then box 146 is entered where the outdoor fan 30 is allowed to continuously run in aid of the defrosting operation.

If, however, the answer in decision box 144 is "yes", then decision box 148 is entered, which limits operation of the outdoor fan 30 as an aid to a defrosting operation to five minutes. Thus, if five minutes have not yet elapsed, then the answer in decision box 148 is "no", and box 146 is entered. If, however, the answer in decision box 148 is "yes", then box 150 is entered to stop operation of the outdoor fan.

An alternate, more sophisticated approach may be employed in determining whether to run the outdoor fan as an aid to defrosting. In this alternate approach, the rate at which sensor temperature increases is monitored in order to recognize a condition where sensor temperature levels off. So long as sensor temperature is rising, the outdoor fan is allowed to run. In the event sensor temperature levels off at a temperature below 32° F., the outdoor fan is stopped. While flowchart steps for this particular form of decision are not shown in the drawings, the necessary steps can be equivalently stated in words:

(1) Store the current sensor temperature reading.

(2) Allow a predetermined time interval to elapse, for example anything from a few seconds to a minute, based on experience with the particular system.

(3) Then compare the prevailing sensor temperature reading to the sensor temperature reading stored in Step (1). If there is a difference (i.e. an increase), then the process is repeated, beginning with Step (1). If no difference, sensor temperature has leveled off, and the final decision is whether temperature has leveled off above or below 32° F. If below, the fan is stopped. Otherwise the fan is allowed to run.

Returning to the FIG. 5 flowchart, finally, decision box 152 represents the decision whether to terminate defrost operation. In box 152, sensor temperature $T_S$ is compared to a threshold set at 36° F. If $T_S$ is greater than 36° F., then the answer is "yes", and the FIG. 6, "exit run" routine is entered, which reenables heating operation, and clears the various defrost flags.

If, however, the answer in decision box 152 is "no", then the FIG. 7 "EXIT DEFROST" routine is entered, which allows the defrosting operation to continue.

While a specific embodiment of the invention has been illustrated and described herein, it is realized that numerous modifications and changes will occur to those skilled in the art. It is therefore to be understood that the appended claims are intended to cover all such modifications and changes which fall within the true spirit and scope of the invention.

What is claimed is:

1. Frost control apparatus for a heat pump having an outdoor heat exchanger susceptible to frosting, and a fan for circulating outdoor ambient air past the outdoor heat exchanger, said apparatus comprising:

means for effecting a defrosting operation by supplying heat to melt frost from the heat exchanger when required;

a temperature sensor positioned at least proximate the heat exchanger such that said sensor can measure ambient temperature when the heat pump is first started and the heat exchanger is free of frost, and such that said sensor becomes surrounded with frost as frost builds up on the heat exchanger during operation of the heat pump; and control means connected to said sensor and to said means for effecting a defrosting operation, said control means including means for reading said sensor and storing the sensor reading as representative of ambient temperature when the heat pump is first started and the heat exchanger is free of frost, and for thereafter at least periodically reading said sensor to determine a prevailing sensor temperature, comparing the prevailing sensor temperature to the stored sensor temperature reading to determine a temperature difference, and initiating a defrosting operation in the event the temperature difference exceeds an established difference reference.

2. Frost control apparatus in accordance with claim 1, wherein said control means further includes means for establishing the difference reference as a function of ambient temperature.

3. Frost control apparatus in accordance with claim 1, wherein the established difference reference is within the approximate range of from 15° F. to 25° F.

4. Frost control apparatus in accordance with claim 2, wherein said mean for establishing the difference reference establishes the difference reference within the approximate range of from 15° to 25° F.

5. Frost control apparatus in accordance with claim 1, wherein said temperature sensor is positioned below said heat exchanger such that water from melting frost runs over said temperature sensor.

6. Frost control apparatus in accordance with claim 1, wherein said control means further includes means for terminating a defrosting operation when sensor temperature exceeds a first predetermined temperature which is in excess of 32° F.

7. Frost control apparatus in accordance with claim 5, wherein said control means further includes means for terminating a defrosting operation when sensor temperature exceeds a first predetermined temperature which is in excess of 32° F.

8. Frost control apparatus in accordance with claim 6, wherein said first predetermined temperature is 36° F.

9. Frost control apparatus in accordance with claim 7, wherein said first predetermined temperature is 36° F.

10. Frost control apparatus in accordance with claim 1, wherein said control means further includes means for operating the fan as an aid to defrosting, but limiting operation of the fan as an aid to defrosting to a predetermined time duration in the event ambient temperature is below a second predetermined temperature.

11. Frost control apparatus in accordance with claim 10, wherein said predetermined time duration is in the order of five minutes, and said second predetermined temperature is approximately 31° F.

12. Frost control apparatus in accordance with claim 1, wherein said control means further includes means for operating the fan as an aid to defrosting, determining the rate at which sensor temperature rises during a defrosting operation, allowing the outdoor fan to operate as an aid to defrosting so long as sensor temperature is rising, and stopping operation of the outdoor fan in the event sensor temperature levels off at a temperature below 32° F.

13. A method for controlling defrosting in a heat pump having an outdoor heat exchanger susceptible to frosting and a fan for circulating outdoor ambient air past the outdoor heat exchanger, said method comprising:

providing a temperature sensor positioned at least proximate the heat exchanger such that the sensor can measure ambient temperature when the heat pump is first started and the heat exchanger is free of frost, and such that the sensor becomes surrounded with frost as frost builds up on the heat exchanger during operation of the heat pump;

determining ambient temperature when the heat pump is first started and the heat exchanger is free of frost by reading the sensor and storing the sensor reading; and thereafter at least periodically reading the sensor to determine a prevailing sensor temperature, comparing the prevailing sensor temperature to the stored temperature to determine a temperature difference, and initiating a defrosting operation in the event the temperature difference exceeds an established difference reference.

14. A method in accordance with claim 13, which further comprises establishing the difference reference as a function of ambient temperature.

15. A method in accordance with claim 14, which comprises establishing the difference reference within the approximate range of from 15° to 25° F.

16. A method in accordance with claim 13, which comprises positioning the temperature sensor below the heat exchanger such that water from melting frost runs over the temperature sensor.

17. A method in accordance with claim 13, which comprises terminating a defrosting operation when sensor temperature exceeds a first predetermined temperature which is in excess of 32° F.

18. A method in accordance with claim 16, which comprises terminating a defrosting operation when sensor temperature exceed a first predetermined temperature which is in excess of 32° F.

19. A method in accordance with claim 13, which further comprises operating the fan as an aid to defrosting, but limiting operation of the fan as an aid to defrosting to a predetermined time duration in the event ambient temperature is below a second predetermined temperature.

20. A method in accordance with claim 13, which further comprises:

operating the fan as an aid to defrosting;

determining the rate at which sensor temperature rises during a defrosting operation; and allowing the outdoor fan to operate as an aid to defrosting so long as sensor temperature is rising, and stopping operation of the outdoor fan in the event sensor temperature levels off at a temperature below 32° F.

* * * * *